US007174573B1

(12) United States Patent
Chen et al.

(10) Patent No.: US 7,174,573 B1
(45) Date of Patent: Feb. 13, 2007

(54) DECORATIVE MULTIPLE LAYERED HAT

(76) Inventors: Hseuhon Chen, 11 F., No. 88, Sec. 1, Dunhua S. Rd., Taipei (TW); Hsin Chang Chen, No. 26, Lioujhou St., Wanhua Dist., Taipei (TW); Ying Ta Lu, 9F., No. 720, Wen-Lin Rd., Shi-Lin, Taipei (TW)

( * ) Notice: Subject to any disclaimer, the term of this patent is extended or adjusted under 35 U.S.C. 154(b) by 0 days.

(21) Appl. No.: 11/336,083

(22) Filed: Jan. 20, 2006

(51) Int. Cl.
*A42C 5/04* (2006.01)

(52) U.S. Cl. ..... 2/209.5; 2/195.1

(58) Field of Classification Search ..... 2/209.5, 2/209.7

See application file for complete search history.

(56) References Cited

U.S. PATENT DOCUMENTS 4,551,860 A * 11/1985 Smit et al. ..... 2/209.7
4,989,270 A * 2/1991 Boughten ..... 2/171.7
5,159,720 A * 11/1992 Scott, Jr. ..... 2/171
5,819,318 A * 10/1998 Tse ..... 2/182.1
5,855,023 A * 1/1999 Clingenpeel et al. ..... 2/7

* cited by examiner

*Primary Examiner*—Katherine M. Moran
(74) *Attorney, Agent, or Firm*—Pai Patent & Trademark Law Firm; Chao-Chang David Pai

(57) ABSTRACT

The decorative multiple layered hat has multiple layers. The multiple layers are made of different materials, have different structures and features, are joined together sequentially to form a shape with a surface by different layers being exposed so the hat has an appealing appearance and raises people's interests and include an outer layer, a ventilative layer, a mesh layer, a fabric layer and an outer surface. The outer area has cutout areas. The ventilative layer is bonded to the outer area and has multiple perforations through which air flows. The mesh layer is a mesh through which air flows to keep a person's head cool and is bonded to the ventilative layer. The inner layer is bonded to the mesh layer, touches a person's skin and is a soft fabric so the hat is comfortable. The outer surface has patterns formed by the cutouts in the outer layer.

10 Claims, 4 Drawing Sheets

DECORATIVE MULTIPLE LAYERED HAT

BACKGROUND OF THE INVENTION

1. Field of the Invention

The present invention relates to a hat, and more particularly to a decorative multiple layered hat having multiple layers with different features and made of different material to provide strength, ventilation and a unique textured appearance.

2. Description of Related Art

Hats are made of many materials including fabric, felt, synthetic material such as nylon and plastic, natural fibers and the like and are worn to provide warmth, screening from sunshine, identification for teams or functional groups and as a fashionable or stylish accessory. Furthermore, hats are available in a wide range of shapes, colors and types such as ball caps, berets, fedoras and the like. However, the conventional hats are usually made of thin, single-layered material that quickly lose their shape and become unsightly.

Conventional hats also provide some level of protection from flying or falling object by cushioning the impact of such an object, but when the hats become old and dilapidated they lose any cushioning effect, and a person's head may be injured when struck by such an object. Although safety helmets have been created to provide very good head-protection, but they are usually heavy and hot. Consequently, few people wear safety helmets as a part of everyday dressing.

The present invention therefore provides a decorative multiple layered hat to obviate or mitigate the aforementioned problems.

SUMMARY OF THE INVENTION

An objective of the present invention is to provide a decorative multiple layered hat for warmth, decorative effect, ventilation and some level of head-protection, and which is comfortable and light-weight to wear.

To achieve the objective, the decorative multiple layered hat comprises multiple layers. Each layer are made of different materials, have different structures and features. The multiple layers are joined together sequentially to form a shape with a surface by different layers being exposed so the hat has an appealing appearance and raises people's interests.

The layers of the decorative multiple layered hat includes an outer layer, a ventilative layer, a mesh layer, and a fabric layer The outer layer has a outer surface with cutout areas. The ventilative layer and mesh layer is bonded to the outer layer and has multiple perforations through which air flows to keep a person's head cool. The inner layer is bonded to the mesh layer, touches a person's skin and is a soft fabric so the hat is comfortable wearing. The appearance of the decorative multiple layered hat can have patterns formed by designing the ventilative layer and the mesh layer to expose at cutouts of the outer layer.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
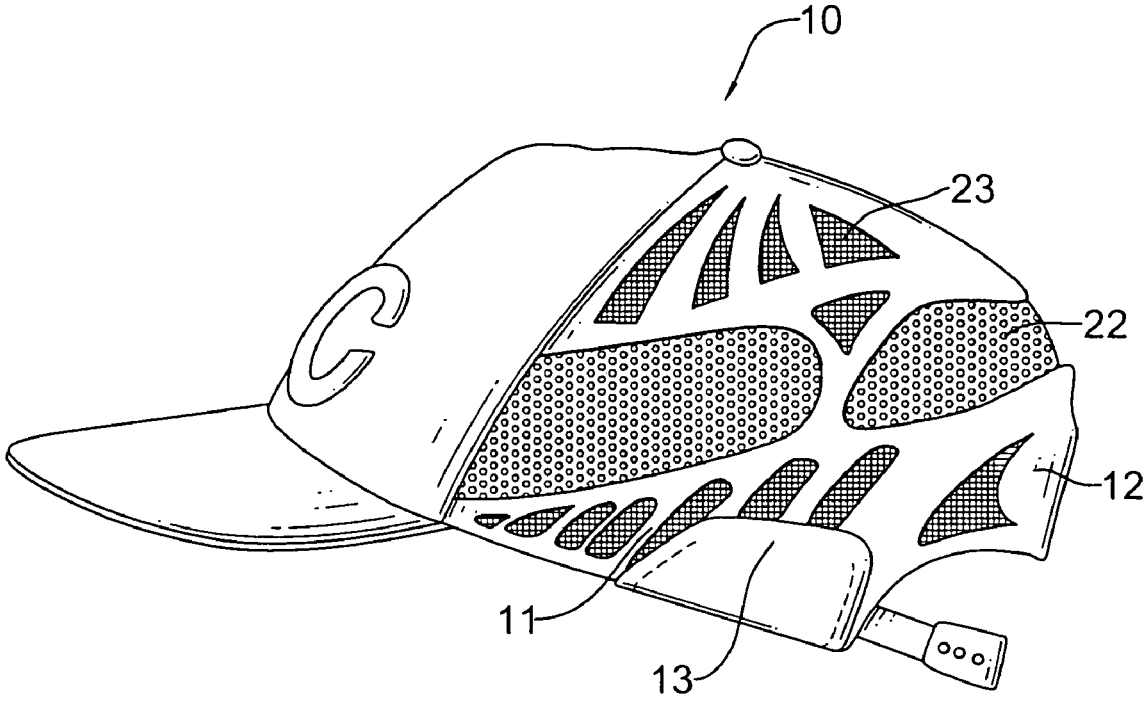
FIG. 1 is a side view of a decorative multiple layered hat in accordance with the present invention.

With reference to FIG. 1, a the decorative multiple layered hat in accordance with the present invention can be a ball cap (10), a fedora or the like and comprises multiple layers (20).

Figure 2:
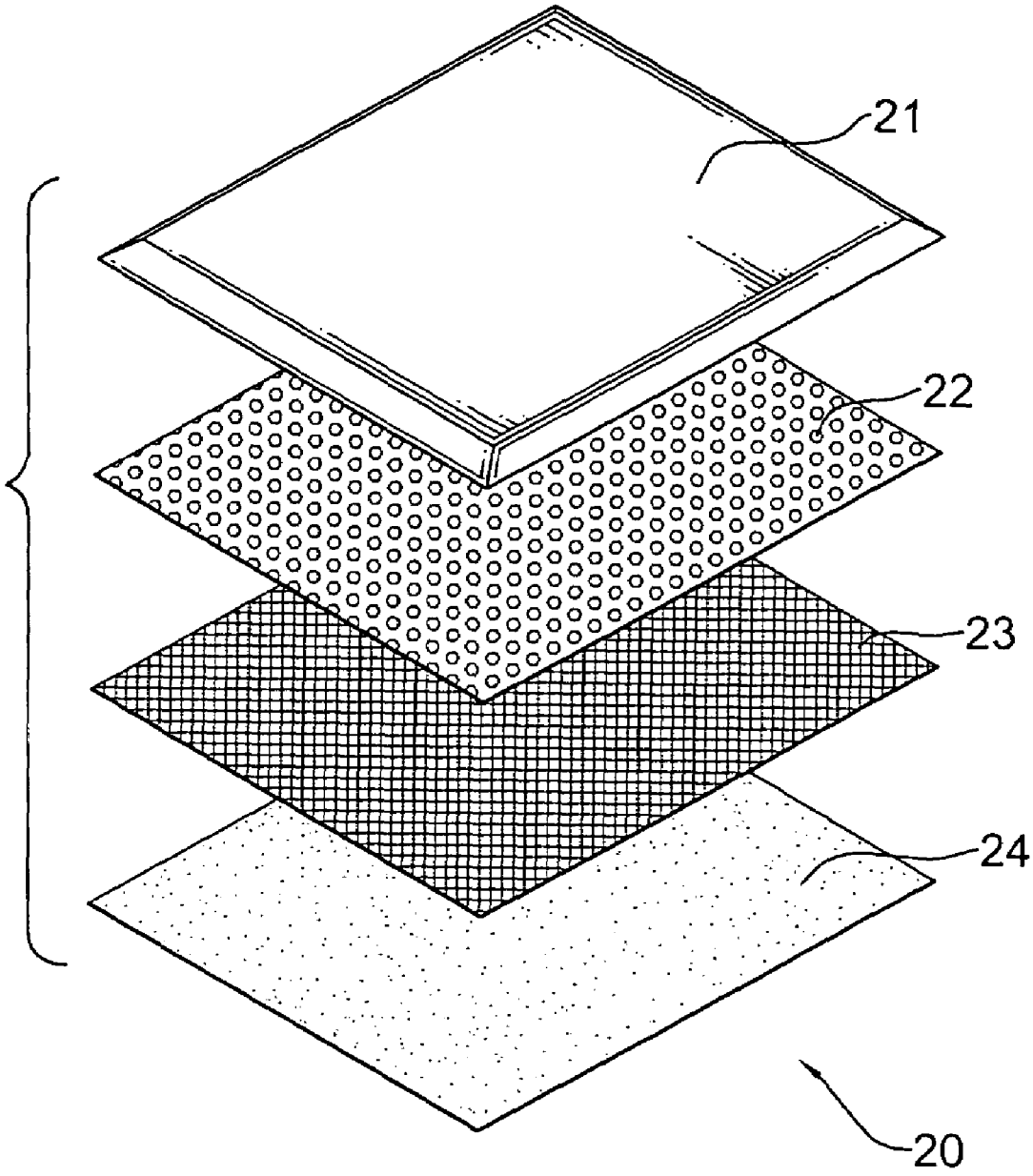
FIG. 2 is an exploded perspective view of layers of the decorative multiple layered hat in FIG. 1.
Figure 3:
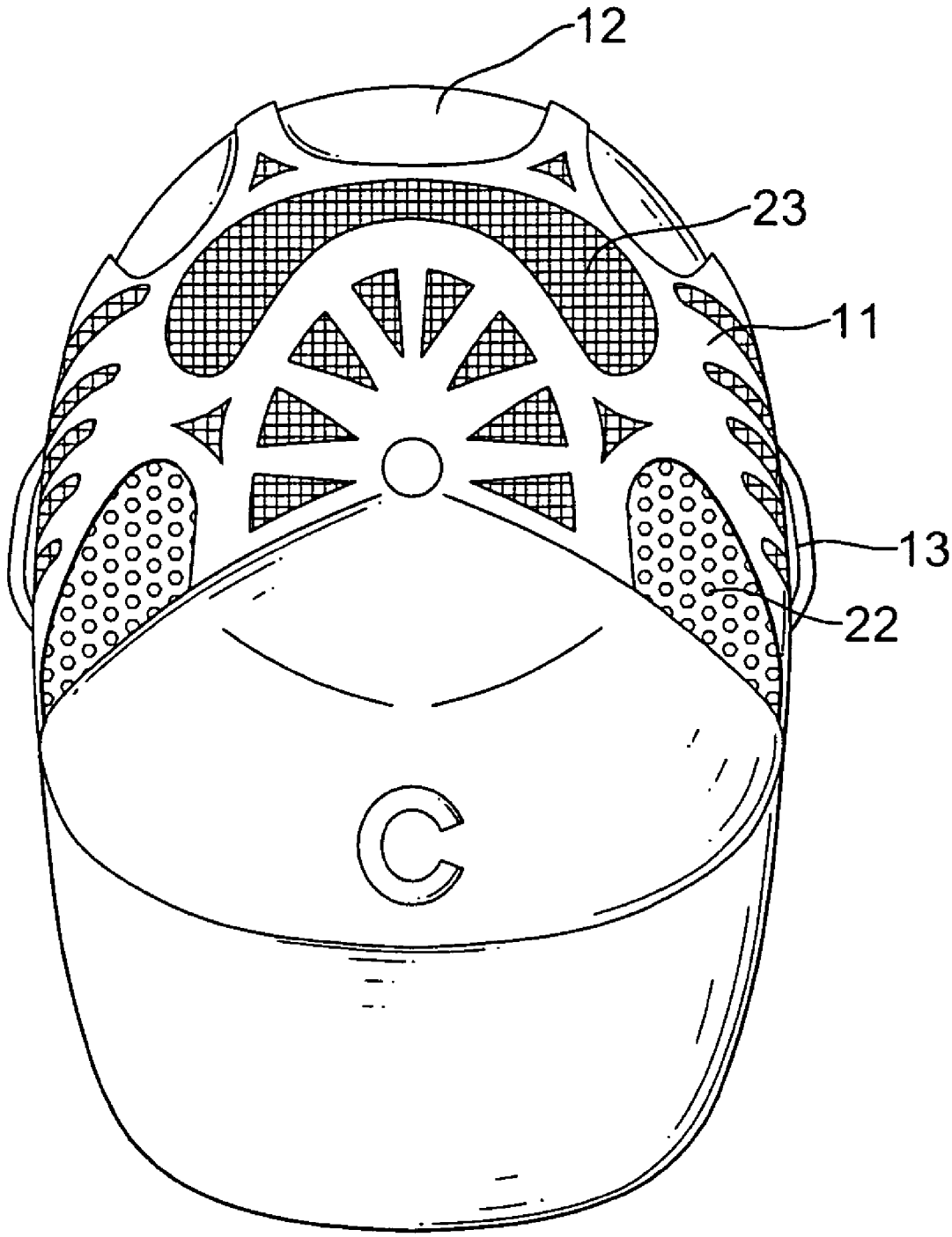
FIG. 3 is a top view of the decorative multiple layered hat in FIG. 1.
Figure 4:
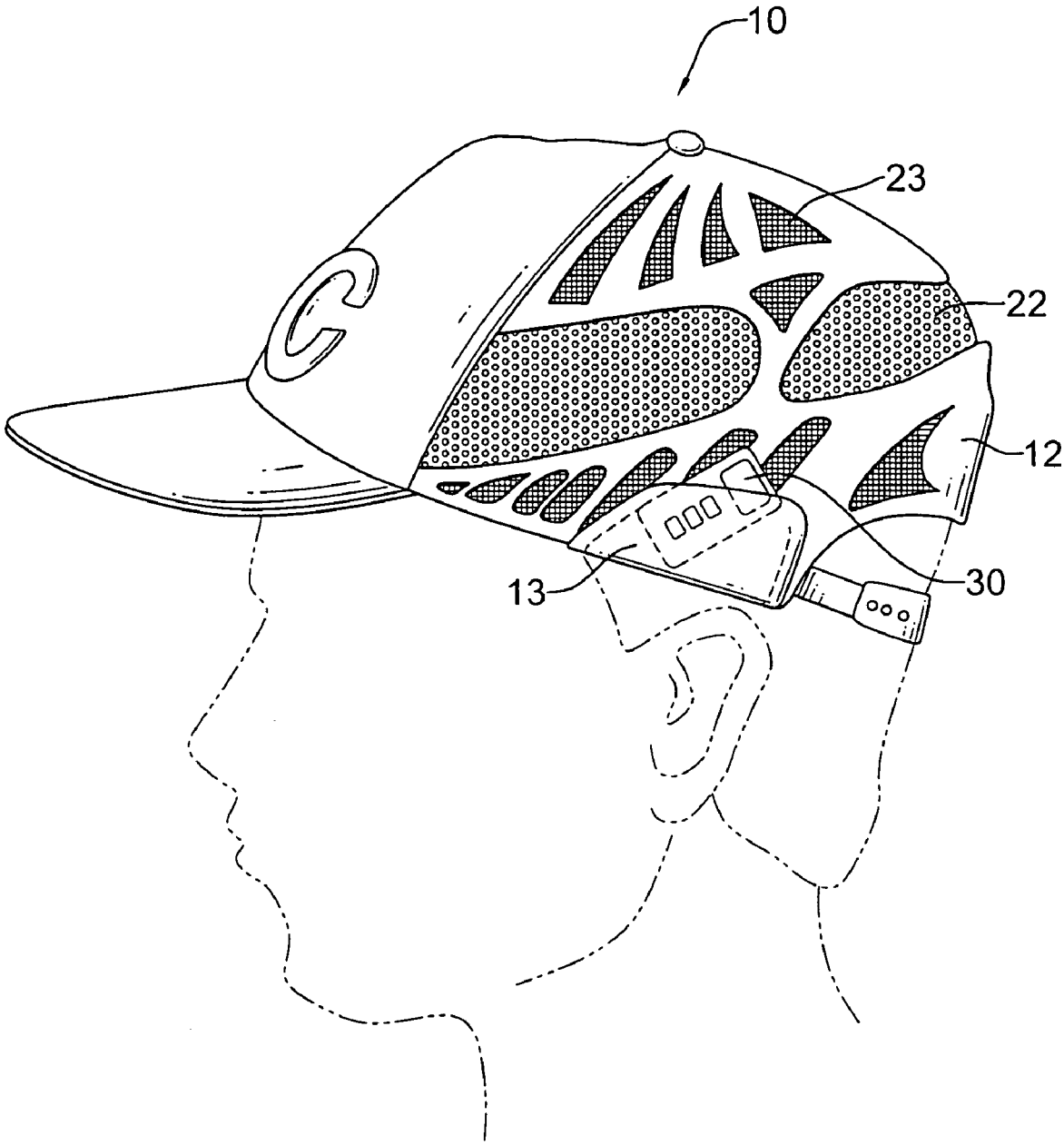
FIG. 4 is an operational side view of the decorative multiple layered hat in FIG. 1.

With further reference to FIGS. 2, 3 and 4, Each layer of the multiple layers (20) are made of different materials having different structures and features. The multiple layers (20) are bonded together sequentially to form a shape by different layers (21, 22, 23, 24) being exposed so the hat has an appealing appearance and raises people's interests.

The ball cap (10) has an outer surface and optional small pockets (13). The multiple layers (20) of the ball cap (10) includes an outer layer (21), a ventilative layer (22), a mesh layer (23), and a fabric layer (24). The layers (21, 22, 23, 24) may be glued together or bonded together using other conventional techniques.

The outer layer (21) is resilient and shock-absorbing material such as polyurethane or rubber, has an inner surface and cutout areas and may have multiple protective bands (11) and lumps (12). The protective bands (11) and lumps (12) correspond to a person's forehead and other sensitive areas of a person's head to provide protection.

The ventilative layer (22) is soft material, is bonded to the inner surface of the outer layer (21), is visible through cutout areas in the outer layer (21) and has an inner surface, multiple perforations and optional cutout areas. The perforations are formed through the ventilative layer (22) and allow air to flow through the perforations and cool a person wearing the hat.

The mesh layer (23) is a mesh of metal strands, synthetic fibers, carbon fibers or the like to strengthen the ball cap (10) and allow air to flow through the mesh, is bonded to the inner surface of the ventilative layer (22), is visible through cutouts in the ventilative layer (22) and has an inner surface.

The inner layer (24) is bonded to the inner surface of the mesh layer (23), touches a person's skin and is a soft fabric to make the hat comfortable against a person's skin.

The outer surface has patterns formed by the cutouts in the outer layer (21) and the ventilative layer (22) to add different textures and enhance the visual appearance of the decorative ball cap (10).

With further reference to FIG. 4, the small pockets (13) are formed on the outer surface, each can be used to hold a small article like an MP3 player (30) so that make the small article be easy-carrying then more convenience be provided.

Even though numerous characteristics and advantages of the present invention have been set forth in the foregoing description together with details of the structure and function of the invention, the disclosure is illustrative only. Changes may be made in detail especially in matters of shape, size, and arrangement of parts within the principles of the invention to the full extent indicated by the broad general meaning of the terms in which the appended claims are expressed.

What is claimed is:

1. A decorative multiple layered hat comprising multiple layers made of different materials, being bonded together sequentially to form a shape and comprising:

an outer layer being a resilient and shock-absorbing material and having an inner surface and cutout areas;

a ventilative layer being a soft material, bonded to the inner surface of the outer layer, being visible through the cutout areas in the outer layer and having multiple perforations formed through the ventilative layer;

a mesh layer being a mesh to strengthen the decorative multiple layered hat, being bonded to the inner surface of the ventilative layer and having an inner surface, an inner layer bonded to the inner surface of the mesh layer for touching a person's skin and being a soft fabric; and having an outer surface having patterns formed by the cutouts in the outer layer.

2. The decorative multiple layered hat as claimed in claim 1, wherein the decorative multiple layered hat is a cap.

3. The decorative multiple layered hat as claimed in claim 1, wherein the multiple layers further have small pockets formed on the outer surface.

4. The decorative multiple layered hat as claimed in claim 1, wherein the outer layer is made of polyurethane.

5. The decorative multiple layered hat as claimed in claim 1, wherein the outer layer is made of rubber.

6. The decorative multiple layered hat as claimed in claim 1, wherein the mesh layer is made of metal strands.

7. The decorative multiple layered hat as claimed in claim 1, wherein the mesh layer is made of synthetic fibers.

8. The decorative multiple layered hat as claimed in claim 1, wherein the mesh layer is made of carbon fibers.

9. The decorative multiple layered hat as claimed in claim 1, wherein the ventilative layer further has cutout areas; and the mesh layer is visible through the cutout areas in the ventilative layer.

10. The decorative multiple layered hat as claimed in claim 1, wherein the outer layer further has multiple protective bands and lumps adapted for corresponding to a person's forehead and other sensitive areas of a person's head.

* * * * *